US009856673B2

(12) United States Patent
Yang

(10) Patent No.: US 9,856,673 B2
(45) Date of Patent: Jan. 2, 2018

(54) TENT

(71) Applicant: TOPSUN CREATIVE DESIGN, Hangzhou (CN)

(72) Inventor: Baoqing Yang, Hangzhou (CN)

(73) Assignee: Topsun Creative Design, Hangzhou (CN)

( * ) Notice: Subject to any disclaimer, the term of this patent is extended or adjusted under 35 U.S.C. 154(b) by 0 days.

(21) Appl. No.: 14/736,767

(22) Filed: Jun. 11, 2015

(65) Prior Publication Data

US 2016/0290003 A1 Oct. 6, 2016

(30) Foreign Application Priority Data

Apr. 1, 2015 (CN) ..... 2015 2 0193597 U

(51) Int. Cl.

| | |
|---|---|
| ***E04H 15/48*** | (2006.01) |
| ***E04H 15/60*** | (2006.01) |
| ***E04H 15/36*** | (2006.01) |
| ***E04H 15/42*** | (2006.01) |
| *E04H 15/64* | (2006.01) |

(52) U.S. Cl.

CPC ..... *E04H 15/48* (2013.01); *E04H 15/36* (2013.01); *E04H 15/42* (2013.01); *E04H 15/60* (2013.01); *E04H 15/64* (2013.01)

(58) Field of Classification Search

CPC ..... E04H 15/40; E04H 15/42; E04H 15/36; E04H 15/405; E04H 15/425; E04H 15/48; E04H 15/60

USPC ..... 135/156, 125, 136, 124, 138, 143, 144, 135/151, 153

See application file for complete search history.

(56) References Cited

U.S. PATENT DOCUMENTS 3,223,098 A * 12/1965 Dole, Jr. ..... E04H 15/425 135/118
3,621,857 A * 11/1971 May et al. ..... E04H 15/00 135/117
3,670,747 A * 6/1972 Pohl ..... E04H 15/00 135/156
4,003,181 A * 1/1977 Robinson ..... E04H 15/42 135/115
4,078,572 A * 3/1978 Moss ..... E04H 15/40 135/118

(Continued)

FOREIGN PATENT DOCUMENTS

JP 05171838 A * 7/1993

*Primary Examiner* — Robert Canfield
(74) *Attorney, Agent, or Firm* — Fitch, Even, Tabin & Flannery LLP

(57) ABSTRACT

A tent includes a tent fabric and a supporting pole. The supporting pole is connected to the tent fabric for supporting the tent fabric. The tent further includes a first top pole and a securing and connecting device, and the securing and connecting device is connected to the tent fabric. When the tent is put up, the first top pole is inserted into the securing and connecting device, and the first top pole and the supporting pole are crosswise arranged, the securing and connecting device is located at an extension direction of the first top pole. Since a cross structure is formed at a top of the tent and the first top pole is secured by the securing and connecting device, a supporting plane can be formed at the top of the tent when the tent is put up, expending the usable area at the top of the tent.

7 Claims, 4 Drawing Sheets

(56) References Cited

U.S. PATENT DOCUMENTS 4,269,210 A * 5/1981 Marks ..... E04H 15/14 135/125
4,285,355 A * 8/1981 Lundblade ..... E04H 15/42 135/147
4,709,718 A * 12/1987 Nichols ..... E04H 15/40 135/115
5,333,634 A * 8/1994 Taylor ..... E04H 15/28 135/118
5,404,896 A * 4/1995 Howe ..... E04H 6/42 135/119
5,615,699 A * 4/1997 Lee ..... E04H 15/64 135/118
6,463,948 B2 * 10/2002 Lee ..... E04H 15/44 135/136
D562,930 S * 2/2008 Poulson et al. ..... D21/834
7,673,642 B1 * 3/2010 Shires ..... E04H 15/36 135/119
8,590,554 B2 * 11/2013 Choi ..... E04H 15/42 135/120.2
9,243,423 B2 * 1/2016 Jin ..... E04H 15/48
2012/0055525 A1 * 3/2012 Choi ..... E04H 15/48 135/147
2012/0318316 A1 * 12/2012 Choi ..... E04H 15/48 135/135
2014/0076372 A1 * 3/2014 Jin ..... E04H 15/46 135/139
2014/0311540 A1 * 10/2014 Choi ..... E04H 15/42 135/143
2015/0068573 A1 * 3/2015 Jin ..... E04H 15/42 135/147
2015/0167344 A1 * 6/2015 Li ..... E04H 15/48 135/143
2016/0060897 A1 * 3/2016 Baoqing ..... E04H 15/60 135/146
2016/0281385 A1 * 9/2016 Choi ..... E04H 15/48
2016/0290001 A1 * 10/2016 Choi ..... E04H 15/48

* cited by examiner

TENT

CROSS-REFERENCE TO RELATED APPLICATIONS

The present application claims the benefit of priority to Chinese patent application No. 201520193597.6 titled "TENT", filed with the Chinese State Intellectual Property Office on Apr. 1, 2015, the entire disclosure of which is incorporated herein by reference.

TECHNICAL FIELD

The present application relates to the technical field of outdoor recreation, and in particular to a tent.

BACKGROUND

Outdoor recreation has become a favorable and popular relaxing exercise, and a tent has become a necessity of the outdoor recreation. The tent mainly consists of a tent fabric and a supporting frame for supporting the tent fabric, and an inner expansion space is formed by pulling the tent fabric and the supporting frame via windproof ropes and tent pegs.

For expanding the usable space in the tent, multiple supporting poles are generally used in a conventional tent to form a cross structure to hold up a top space. A common structure is a cross shaped or a cross-like shaped supporting structure which is formed by two cross supporting poles. However, such cross structure requires multiple supporting poles, which increases the weight of the whole tent, causing carry difficulties to the tent. Moreover, both of the two cross supporting poles are required to be bent and supported onto the ground, thus the top space of the tent is reduced in structure. Another tent, known as a transverse lined top tent, uses a transverse pole as a top pole to form a support in a transverse direction at the top of the tent. Although the tent with such a structure has a large bottom space, the top of the transverse lined top tent is unable to form a supporting surface at the top, thus the usable space in the tent cannot be expanded.

SUMMARY

For solving the problem that a supporting surface cannot be formed at the top of a tent and a usable space inside the tent cannot be expanded in a conventional tent, a tent is provided by the present application.

A tent includes a tent fabric and a supporting pole, and the supporting pole is connected to the tent fabric for supporting the tent fabric.

The tent further includes a first top pole and a securing and connecting device. The securing and connecting device is connected to the tent fabric. In a case that the tent is put up, the first top pole is inserted into the securing and connecting device and the first top pole and the supporting pole are crosswise arranged, and the securing and connecting device is located in an extension direction of the first top pole.

Since the first top pole and a middle portion of the supporting pole form a cross structure at a top of the tent, and the first top pole is secured by the securing and connecting device on the tent fabric. A supporting plane is formed at the top of the tent when the tent is put up, thereby expanding the usable space at the top of the tent.

Preferably, the tent further includes multiple second top poles. In a case that the tent is put up, the second top poles are arranged at two sides of the supporting pole respectively, and the second top poles are arranged inside the tent fabric, or are hinged to the first top pole.

The second top poles are arranged at two sides of the first top pole, and the first top pole and the second top poles cooperate to support the tent to allow a space of the tent at the left and right directions, of two free ends of the first top pole, to be at a substantially same plane with the first top pole, thus further expending the space at the top of the tent.

Preferably, the securing and connecting device is a securing plate, and the securing plate is connected to a body of the tent fabric. The securing plate is provided with a through-hole. An end portion of the first top pole has a first locking groove. When the tent is put up, an inner edge of the through-hole is stuck in the first locking groove. Or, the securing plate and connecting device is a rigid ring, and each of two ends of the first top pole has a cone shaped surface to be stuck in the rigid ring.

Preferably, a size of the end portion of the first top pole is greater than a size of the through-hole, and the first top pole is unable to be disengaged from the securing plate.

By employing the locking groove to be stuck in the inner edge of the securing plate or the cone shaped surface to be stuck in the rigid ring, the first top pole can be easily assembled. Since the size of the first top pole is greater than the size of the through-hole in the securing plate, the first top pole cannot be disengaged from the securing plate. The first top pole can directly slide along the through-hole to be superposed with the second top pole when the tent is folded up. The first top pole is directly folded inside the tent fabric, preventing being lost, and easy to operate.

Preferably, the supporting pole includes a transverse pole and multiple standing poles, and the transverse pole and the standing poles are connected by a connecting member.

Preferably, the transverse pole and the standing poles are respectively hinged to the connecting member, and in a case that the tent is folded up, the transverse pole and the standing poles can be rotated around respective articulated shafts to be folded together.

Preferably, another securing plate is also provided at positions, corresponding to the standing poles, at a bottom of the tent fabric. An end portion of each of the standing poles is provided with a second locking groove. In a case that the tent is put up, an inner edge of the trough-hole of the securing plate, at the bottom of the tent fabric, is stuck in the second locking groove.

Preferably, each of the standing poles is a multi-section pole, and the multiple sections of the standing pole can be folded and/or stretched out and drawn back.

Preferably, the tent further includes a third top pole, and the third top pole is hinged to the connecting member. In a case that the tent is put up, free ends of the third top pole are at two sides of the transverse pole. In a case that the tent is folded up, the third top pole is rotated around a corresponding articulated shaft to be folded with the transverse pole.

Figure 1:
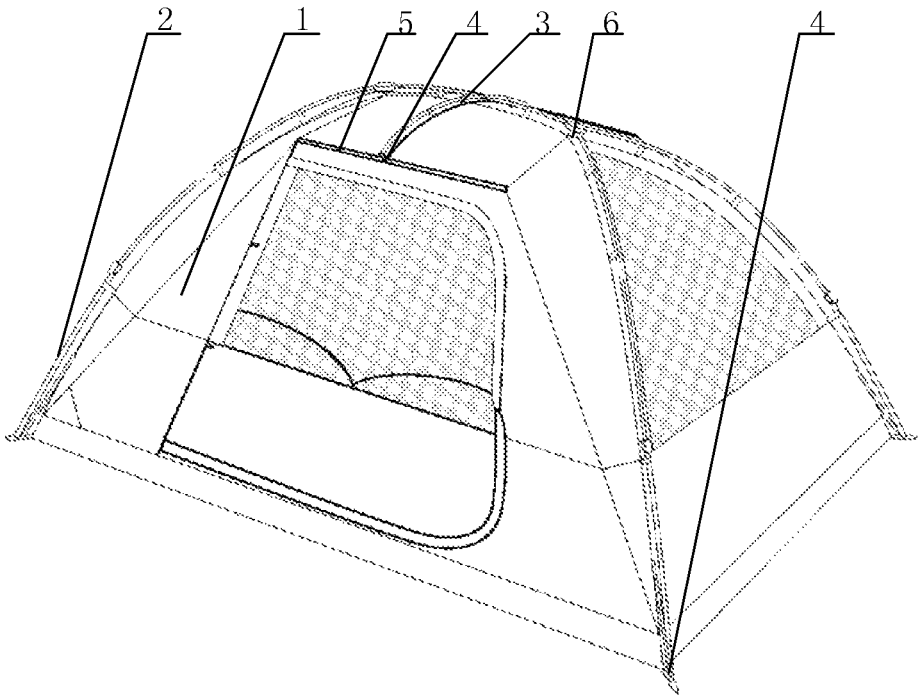
FIG. 1 is a schematic view of a tent in an open state according to a first embodiment of the present application.

Corresponding relationships between reference numerals and components in FIGS. 1 to 8 are as follows:

| | | | | | |
|---|---|---|---|---|---|
| 1 | tent fabric, | 2 | supporting pole, | 21 | transverse pole, |
| 22 | upright pole, | 221 | lower pole, | 222 | middle pole, |
| 223 | upper pole, | 3 | first top pole, | 31 | first locking groove, |
| 4 | securing plate, | 41 | securing plate body, | 42 | through-hole, |
| 43 | connecting rope, | 5 | second top pole, | 6 | fastening. |

DETAILED DESCRIPTION

For those skilled in the art to better understand technical solutions of the present application, the present application is described in detail in conjunction with drawings and embodiments hereinafter.

A first embodiment of the present application is described as follows.

Figure 8:
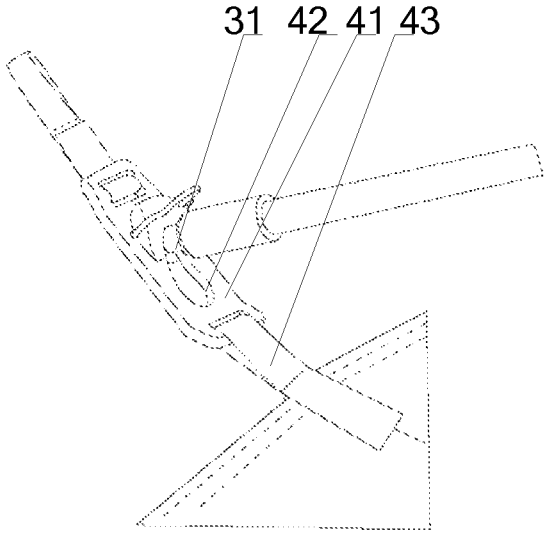
FIG. 8 is a schematic view showing the connection relationship between a first top pole and a securing plate of the tent according to the first embodiment of the present application.

FIGS. 1 to 8 are schematic views of a tent and components thereof according to the first embodiment of the present application. As shown in FIG. 1, the tent according to this embodiment includes a tent fabric 1, a supporting pole 2, a first top pole 3 and securing plates 4. The supporting pole 2 is connected to the tent fabric 1 for mainly supporting the tent fabric 1. The securing plates 4 are located at two sides of the supporting pole 2, respectively, and are buckled to the tent fabric 1 via a buckle or are directly sewed to the tent fabric 1 via sewing threads. Each of the securing plates 4 includes a securing plate body 41 and a through-hole 42 on the securing plate body 41. A first locking groove 31 is provided at each end portion of the first top pole 3. In a case that the tent is put up, an inner edge of the through-hole 42 on the securing plate body 41 is stuck in the first locking groove 31, thereby the first top pole 3 is connected to the tent fabric 1. At the same time, the first top pole 3 contacts the supporting pole 2, holding up a top space of the tent fabric 1 together. The connection between one securing plate 4 and the first top pole 3 is clearly shown in FIG. 8. In this embodiment, the securing plate 4 is sewed to the tent fabric 1 via a connecting rope 43, and a size of the through-hole 42 in the securing plate 4 is gradually decreased to a free end of the securing plate from a connecting end where the securing plate 4 is connected to the tent fabric 1, as shown in FIG. 8. The size of a portion of the through-hole 42 close to the tent fabric 1 may allow the first top pole 2 to pass through the through-hole 42, and the size of a portion of the through-hole 42 away from the tent fabric 1 is smaller, thus an edge of the portion of the through-hole 42 away from the tent fabric can be stuck in the first locking groove 31 at the end portion of the first top pole 3.

It will be appreciated that employing the securing plate 4 to connect the first top pole 3 and the tent fabric 1 is a preferable manner. Other manners in the field via which the tent fabric 1 can be connected to a pole for supporting the tent fabric 1 may also be employed to connect the first top pole 3 and the tent fabric. For example, a rigid ring is commonly used in the field for connecting the tent fabric and pole. The rigid ring is directly sewed onto a corresponding position of the tent fabric, and a cone shaped surface is provided at an end portion of the first top pole 3 for being stuck in the rigid ring. In a case that the tent is required to be put up, the end portion of the first top pole 3 is inserted into the rigid ring so that the cone shaped surface can be stuck in the rigid ring. Apparently, a long groove sewed in the tent fabric may also realize a stuck connection similar to the rigid ring.

Figure 2:
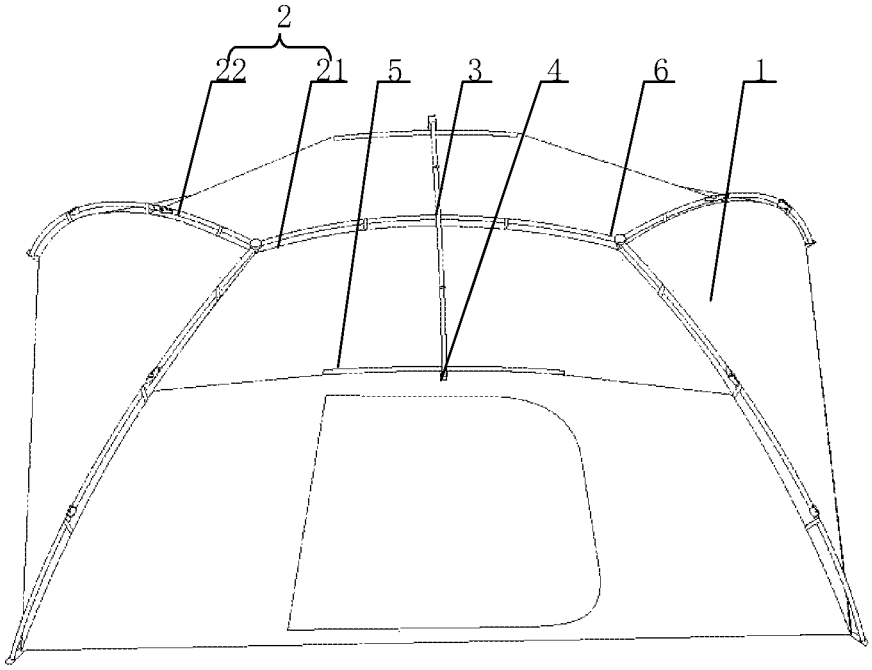
FIG. 2 is a perspective view of the tent in the open state according to the first embodiment of the present application.
Figure 3:
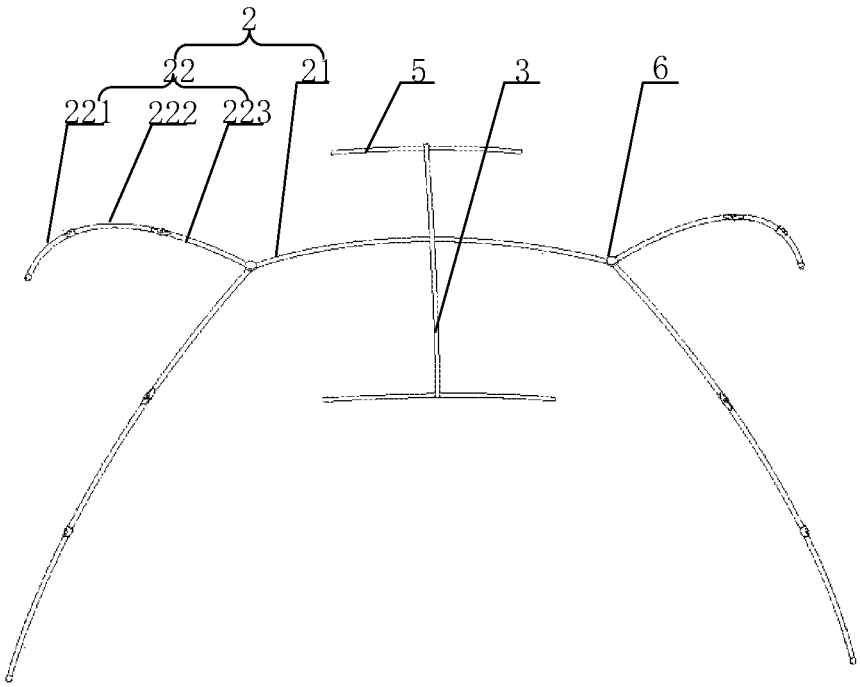
FIG. 3 is a schematic view of a supporting frame of the tent according to the first embodiment of the present application.
Figure 4:
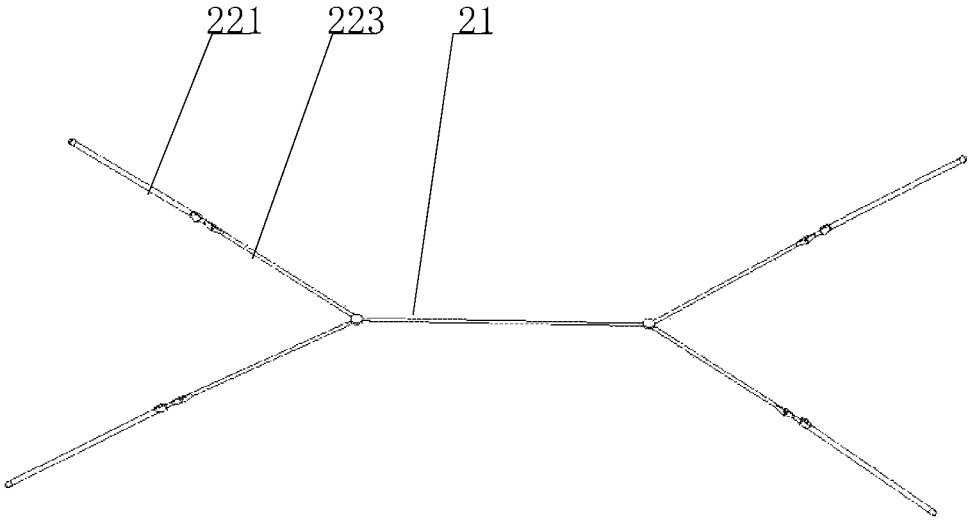
FIG. 4 is a schematic view of a supporting pole in a first folding step according to the first embodiment of the present application.
Figure 5:
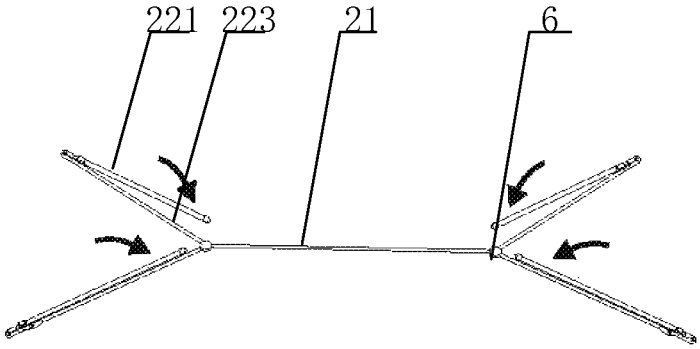
FIG. 5 is a schematic view of the supporting pole in a second folding step according to the first embodiment of the present application.
Figure 6:
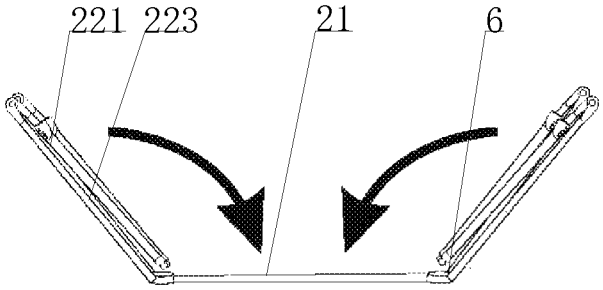
FIG. 6 is a schematic view of the supporting pole in a third folding step according to the first embodiment of the present application.
Figure 7:
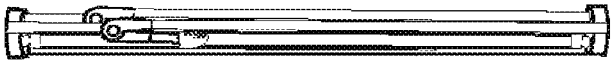
FIG. 7 is a schematic view of the supporting pole in a folded state according to the first embodiment of the present application.

To better support the space at the top of the tent, the tent according to this embodiment further includes multiple second top poles 5, and the second top poles 5 are installed inside the tent fabric 1. When the tent fabric 1 is put up, the second top poles 5 are arranged at two sides of the supporting pole 2 for forming the space at the top of the tent together with the first top pole 3 and the supporting pole 2. In this embodiment, the second top poles 5 are directly sewed onto the inner side of the tent fabric 1, and a middle position of each of the second top poles 5 corresponds to the position where the securing plate 4 is connected to the tent fabric 1. When the tent is put up, the second top poles 5 are in parallel with a middle portion of the supporting pole 2. It will be appreciated that, in this way, a middle supporting area in FIGS. 2 and 3 is formed by the first top pole 3, the second top poles 5 and the middle portion of the supporting pole 2, thereby expanding an area of the top and the space. In other embodiments, the second top poles 5 may be installed inside the tent fabric 1 by other ways. The first top pole 3 may be hinged to the second top pole 5 via an articulation piece, and the articulation piece is capable of securing the first top pole 3 and the second top poles 5 at a position where a certain angle is formed between the first top pole and the each of second top pole, and when the hinging action of the articulation piece is removed, the first top pole and the second top poles may be rotated to be superposed together. And in a case that the tent is put up, each of the second top poles may be secured to the tent fabric by securing two ends of the second top pole to the tent fabric via the securing plate or the rigid ring. Or, the second top poles 5 may be dispensed, thus the space at the top of the tent is directly formed by the first top pole 3 and the supporting pole 2. Considering that tent pegs and windproof ropes may be used in the putting up process of the tent, the windproof ropes may be used for pulling a corresponding portion of the tent to expand the space at the top of the tent.

For facilitating carrying and mounting the first top pole 3 in this embodiment and further facilitating putting up and folding up the whole tent, a size of the end portion of the first top pole 3 is greater than a size of the through-hole 42 in the securing plate 4, thus the first top pole 3 cannot be disengaged from the securing plate 4. The first top pole 3 can be folded up along a direction of the second top pole 5 when the tent is folded up. Other components are folded up after the first top pole is nearly superposed with the second top poles 5. Apparently, in other embodiments, the first top pole 3 may be disengaged from the securing plate 4 when the tent is folded up, thus the first top pole is separately put away.

It will be appreciated that the first top pole 3 and the supporting pole 2 in this embodiment are not connected, but just in contact in the actual using process. In a specific application, the first top pole 3 may be located above the supporting pole 2, or below the supporting pole 2.

The supporting pole 2 according to this embodiment includes a transverse pole 21 and multiple standing poles 22. All the two ends of the transverse pole 21 and the standing poles 22 are hinged to a connecting member 6 for further being rotated around respective shafts. In this embodiment, the connecting member 6 is connected to two standing poles 22. When the tent is folded up, the two standing poles 22 may be rotated to be superposed with each other and then rotated to be superposed with the transverse pole 21 together. Apparently, in other embodiments, the transverse pole 21 and the standing poles 22 may be connected by other manners, for example, the transverse pole 21 and the standing poles 22 may be connected by an elastic rope or a plug connector capable of forming a plug-in connection. In other embodiments, more standing poles 22 may be provided according to a volume of an actual tent and the requirement for supporting stability.

In this embodiment, each of the standing poles 22 may be a pole having three sections. The connection between a lower pole 221 and a middle pole 222 is of a telescopic type, and a buckle is provided between the lower pole 221 and the middle pole 222, and the lower pole 221 and the middle pole 222 can be stretched out and drawn back when the buckle is opened. The middle pole 222 and an upper pole 223 are hinged with each other. The middle pole 222 and the upper pole 223 may be rotatably unfolded or folded by an intermediate articulation piece. It should be noted that, after the standing poles 22 are fully extended, the buckle and the intermediate articulation piece should have a capability of certain position-limiting so as to prevent the lower pole 221 and the middle pole 222 moving or rotating with each other and further allow the tent to be in a complete put up state. Apparently, in principle, the standing pole 22 may be formed by one piece, or secured by other methods to complete a relative positioning, for example, using the above elastic rope to thread the three sections of the upright pole 22.

FIGS. 4 to 7 shows a folding manner of the supporting pole 2 in this embodiment. Firstly the buckle between the lower pole 221 and the middle pole 222 is opened so that the lower pole 221 and the middle pole 222 are superposed to the fullest; then the articulation piece between the middle pole 222 and the upper pole 223 is opened so that the middle pole 222 and the upper pole 223 are rotatably superposed; and then, the two standing poles 22 at the same side of the connecting member 6 are folded so that the folded standing poles 22 are rotated around the connecting member 6 to be superposed with the transverse pole 21 to a degree shown in FIG. 7.

A bottom portion of the tent fabric 1 requires to be securely connected to bottom portions of the standing poles 22 to further extend the bottom portion of the tent to the fullest. In this embodiment, the standing poles 22 and the tent fabric 1 are also connected via the securing plates 4. An end portion of each of the standing poles 22, i.e., a free end of the lower pole 221, has a second locking groove, and an inner edge of the through-hole 42 of one securing plate 4, located at a corresponding position of the bottom portion of the tent fabric 1, is stuck in the second locking groove. In other embodiments, other securing manners may be adopted, such as the above ways of using the rigid ring or the ropes.

In other embodiments of the present application, a third top pole may be provided. The third top pole is connected to the connecting member 6, and forms a certain angle with the transverse pole 21 of the supporting pole 2. When the tent is put up, two free ends of the third top pole are respectively at two sides of the transverse pole 21, and a certain space may be formed by the free ends of the third pole. When the tent is folded up, the third top pole may be hinged to the connecting member 6, and can be rotated to be superposed with the transverse pole 21, which is easy to be folded.

In the embodiment of the present application, all of the first top pole 3, the second top pole 5 and the third top pole are fiber poles, which have a good elasticity, thus making the put up tent look plump and firm. Similarly, the supporting pole 2 may also be a fiber pole, especially the transverse pole 21, the upper pole 223 and the middle pole 222 of the supporting pole 2. Apparently, in other embodiments, a hollow aluminum pipe and other materials commonly used in the field may be employed to make each of the above poles.

After the tent according to this embodiment is put up, a main body of the tent fabric 1 is connected to the supporting pole 2 or each top pole by a corresponding buckle or connecting rope, and is tightly pulled by windproof ropes and tent pegs. When the tent is folded away, the tent fabric 1 may be folded up separately or together with supporting components.

A second embodiment of the present application is described as follows.

Figure 9:
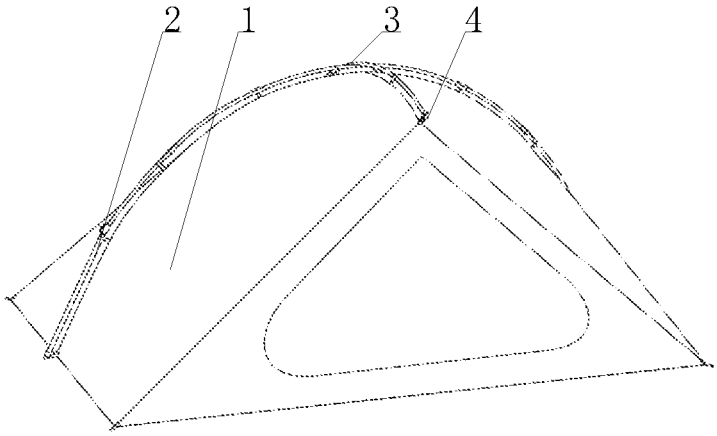
FIG. 9 is a schematic view of a tent in an open state according to a second embodiment of the present application.

FIG. 9 is a schematic view of a tent in an open state according to the second embodiment of the present application. As shown in the Figure, a general structure of the tent in this embodiment is the same as the structure of the tent in the first embodiment, which also includes a tent fabric 1, a supporting pole 2, a first top pole 3 and a securing plate 4. However, the supporting pole 2 according to this embodiment directly employs a foldable long pole, rather than employing the connecting member 6 to connect the standing poles 22 at the two sides of the transverse pole 21 respectively in the first embodiment. In this embodiment, after a main frame for supporting the tent fabric 1 is formed by the supporting pole 21 and the transverse pole 21, the windproof ropes and tent pegs are also required to connect the tent fabric 1 to secure the tent in each side.

The tent in the embodiments of the present application is described in detail hereinbefore. The principle and the embodiments of the present application are illustrated herein by specific examples. The above description of embodiments is only intended to help the understanding of the spirit of the present application. It should be noted that, for the person skilled in the art, a few of improvements and modifications may be made to the present application without departing from the principle of the present application, and these improvements and modifications are also deemed to fall into the scope of the present application defined by the claims.

The invention claimed is:

1. A tent, comprising a tent fabric and a supporting pole, wherein the supporting pole is connected to the tent fabric for supporting the tent fabric and the supporting pole comprises a transverse pole and a plurality of standing poles, the transverse pole and the plurality of standing poles are connected by a connecting member, and the transverse pole and the plurality of standing poles are respectively hinged to the connecting member, and in a case that the tent is folded up, the transverse pole and the standing poles are rotated around respective articulated shafts to be folded together, wherein the tent further comprises a first top pole, and a securing and connecting device, the securing and connecting device is connected to the tent fabric, and in a case that the tent is put up, the first top pole is inserted into the securing and connecting device, and the first top pole and transverse pole are perpendicular and crosswise arranged at a middle point of the transverse pole, and the securing and connecting device is located in an extension direction of the first top pole, wherein the tent further comprises a plurality of second top poles, and in a case that the tent is put up, the second top poles are arranged at two sides of the supporting pole, and the second top poles are arranged inside the tent fabric, or are hinged to the first top pole, wherein a length of the transverse pole is greater than a length of each of the second top poles, wherein each of the second top poles is parallel with the transverse pole.

2. The tent according to claim 1, wherein the securing and connecting device is a securing plate, and the securing plate is connected to a body of the tent fabric, and the securing plate is provided with a through-hole, an end portion of the first top pole has a first locking groove, and when the tent is put up, an inner edge of the through-hole is stuck in the first locking groove.

3. The tent according to claim 2, wherein a size of the end portion of the first top pole is greater than a size of the through-hole, and the first top pole is unable to be disengaged from the securing plate.

4. The tent according to claim 2, wherein another securing plate is also provided at positions, corresponding to the standing poles, of a bottom of the tent fabric, an end portion of the standing pole is provided with a second locking groove, in a case that the tent is put up, an inner edge of the through-hole of the securing plate, located at the bottom of the tent fabric, is stuck in the second locking groove.

5. The tent according to claim 4, wherein the standing pole is a multi-section pole, and the multiple sections of the standing pole are foldable and/or stretchable.

6. The tent according to claim 1, wherein the securing and connecting device is a securing plate, and the securing plate is connected to a body of the tent fabric, and the securing plate is provided with a through-hole, an end portion of the first top pole has a first locking groove, and when the tent is put up, an inner edge of the through-hole is stuck in the first locking groove, or, the securing and connecting device is a rigid ring, and each of two ends of the first top pole has a cone shaped surface to be stuck in the rigid ring.

7. The tent according to claim 1, wherein the securing and connecting device is a rigid ring, and each of two ends of the first top pole has a cone shaped surface to be stuck in the rigid ring.

* * * * *